US006108875A

United States Patent [19]

Anscher

[11] Patent Number: 6,108,875

[45] Date of Patent: Aug. 29, 2000

[54] LOCKABLE STRAP DIVIDER

[75] Inventor: Joseph Anscher, Muttontown, N.Y.

[73] Assignee: National Molding Corp., Farmingdale, N.Y.

[21] Appl. No.: 09/313,397

[22] Filed: May 18, 1999

[51] Int. Cl.[7] ..... A44B 11/06

[52] U.S. Cl. ..... 24/198; 24/170; 24/543

[58] Field of Search ..... 2/322, 421; 24/170, 24/191–193, 198, 200, 543, 518, 487

[56] References Cited

U.S. PATENT DOCUMENTS

| | | |
|---|---|---|
| 4,309,799 | 1/1982 | Noda . |
| 4,356,599 | 11/1982 | Larson et al. . |
| 5,156,023 | 10/1992 | Bevolo . |
| 5,511,289 | 4/1996 | Melia . |
| 5,608,918 | 3/1997 | Salvaggio . |
| 6,044,527 | 4/2000 | Ishida et al. . |

*Primary Examiner*—James R. Brittain
*Attorney, Agent, or Firm*—Collard & Roe, P.C.

[57] ABSTRACT

A lockable strap divider comprising a strap receiving portion having side walls and a transverse bar mounted at a central point between the side walls, and a clamping portion pivotally connected to the rear end of the strap receiving portion. There is a clamping device on the two portions for releasably locking the clamping portion over the strap receiving portion. Unlocking the clamping device from the strap receiving portion allows straps threaded through the transverse bar on the strap receiving portion to be adjusted. Locking the clamping portion over the strap receiving portion locks the straps in place. The locking and unlocking of the clamping portion can easily be done while the helmet is still on the wearer's head, so that adjustments can be made without removing the helmet. The adjustments can also usually be done with one hand.

9 Claims, 4 Drawing Sheets

LOCKABLE STRAP DIVIDER

BACKGROUND OF THE INVENTION

1. Field of the Invention

This invention relates to a novel clamp for locking divided straps into a set position. In particular, the invention relates to a clamp for use on a helmet to secure the helmet straps at a desired size.

2. The Prior Art

Bicycle helmets traditionally have two sets of divided straps on either side of the head. These straps connect via a two-piece buckle either below the chin or on one side of the head to secure the helmet to the wearer's head. The divided straps are brought together at a mid-point and secured in place by a buckle or clip. The divided strap configuration allows for greater stability of the chin strap-helmet configuration. The wearer adjusts the straps to the desired length through the buckle or clip.

One buckle of this type is shown in U.S. Pat. No. 5,469,583 to Akeley et al. This patent discloses a hinged strap locking buckle that when opened, allows the straps to be adjusted. When the buckle is closed, the straps are locked into a set position.

Another device of this type is shown in U.S. Pat. No. 5,666,700 to Anscher et al. This device comprises a main body for receiving the straps, and a rotatable clamping member for securing and adjusting the straps when desired.

While these two devices are adequate for clamping and adjusting the straps, it would be desirable to have a strap adjuster that can be manufactured in one piece and which is easy to operate.

SUMMARY OF THE INVENTION

It is therefore an object of the present invention to provide a strap divider that can be used to adjust and lock the dividing straps in place in a simple and effective manner.

It is another object of the invention to provide a strap divider that can be manufactured as a one-piece unit.

It is another object of the invention to provide a strap divider that is simple and inexpensive to manufacture.

These and other objects are achieved by a lockable strap divider comprising a strap receiving portion having side walls and a transverse bar mounted at a central point between the side walls, and a clamping portion pivotally connected to the rear end of the strap receiving portion. There is a clamping device on the two portions for releasably locking the clamping portion over the strap receiving portion. Unlocking the clamping device from the strap receiving portion allows straps threaded through the transverse bar on the strap receiving portion to be adjusted. Locking the clamping portion over the strap receiving portion locks the straps in place. The locking and unlocking of the clamping portion can easily be done while the helmet is still on the wearer's head, so that adjustments can be made without removing the helmet. The adjustments can also usually be done with one hand.

The clamping portion is preferably integrally formed with the strap receiving portion via a living hinge. This configuration has the advantage of easier manufacturing, as well as easier use while on the helmet, since there is no risk that one of the pieces may become separated from the other.

The clamping device preferably comprises at least one latch disposed on one of the clamping portion and the strap receiving portion and at least one aperture on the other of the clamping portion and the strap receiving portion. The aperture engages the latch to lock the clamping portion over the strap receiving portion. Preferably, the latch is disposed on the strap receiving portion and the aperture is disposed on the clamping portion. There are preferably two latches and two apertures, however, any suitable number may be used.

The clamping portion has a flap along the front end, which extends perpendicular to the top and bottom surfaces of the clamping portion. The apertures are located on the flap to connect with the latches. The flap flexes slightly to slide over the latches before they engage the apertures. To release the clamping portion from the strap receiving portion, the flap is flexed outward until the apertures clear the latches.

To increase the frictional grip on the straps, there are a plurality of protrusions disposed on the bottom surface of the clamping portion for gripping the straps. There are also a plurality of protrusions disposed on the transverse bar of the strap receiving portion for gripping the straps. The two rows of protrusions grip both straps and increase the frictional hold of the strap divider, so that the straps cannot slide once the clamping portion is locked over the strap receiving portion.

The device can be of any suitable shape, but a preferred shape is that of a hexagon.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figures 1, 2:
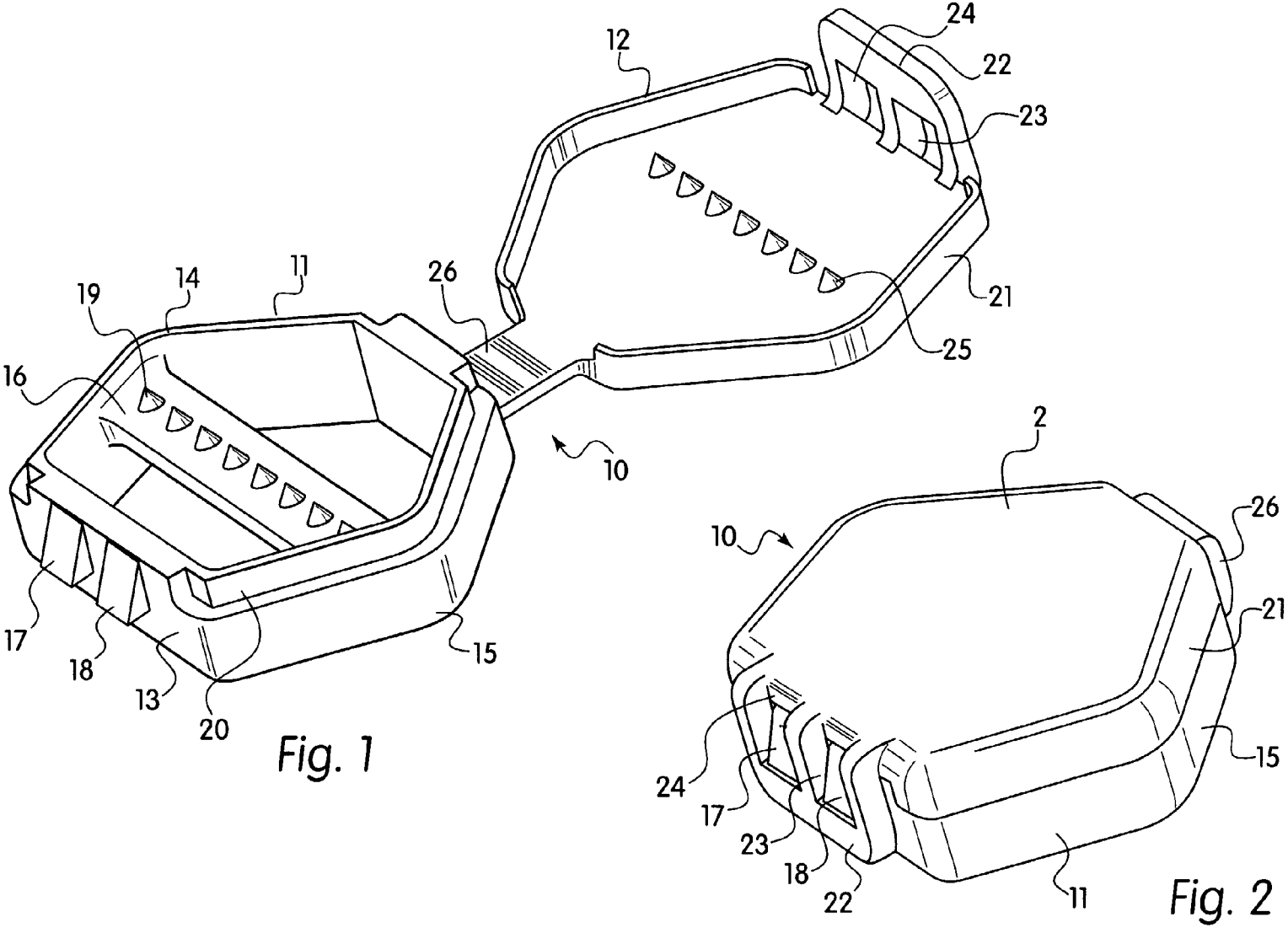
FIG. 1 shows a perspective view of the strap divider in an open position.
FIG. 2 shows a perspective view of the strap divider in a locked position.

Referring now in detail to the drawings and, in particular, FIGS. 1 and 2 show the strap divider 10 according to the invention. Strap divider 10 is comprised of a strap receiving portion 11 connected to a clamping portion 12 via living hinge 26.

Strap receiving portion 11 is comprised of side walls 14 and 15 connected by end 13. A transverse bar 16 extends across a mid-point of walls 14 and 15. End 13 is equipped with latches 17 and 18 for attaching to an end of clamping portion 12. There are a plurality of protrusions 19 along transverse bar 16 for gripping onto straps that are threaded through transverse bar 16. A slot 20 extends around side walls 14 and 15 for receiving clamping portion 12.

Clamping portion 12 is comprised of side walls 21, which insert into groove 20 of strap receiving portion 11, and a flap 22, which extends along the free end of clamping portion 12 in a direction perpendicular to the surface of clamping portion 12. Flap 22 has two apertures 23 and 24 for engaging latches 17 and 18 on strap receiving portion 11. Flap 22 flexes slightly to allow it to pass over latches 17 and 18 until latches 17 and 18 engage apertures 23 and 24, as shown in FIG. 2. To release clamping portion 12, flap 22 is flexed outward until apertures 23 and 24 clear latches 17 and 18.

Figure 3:
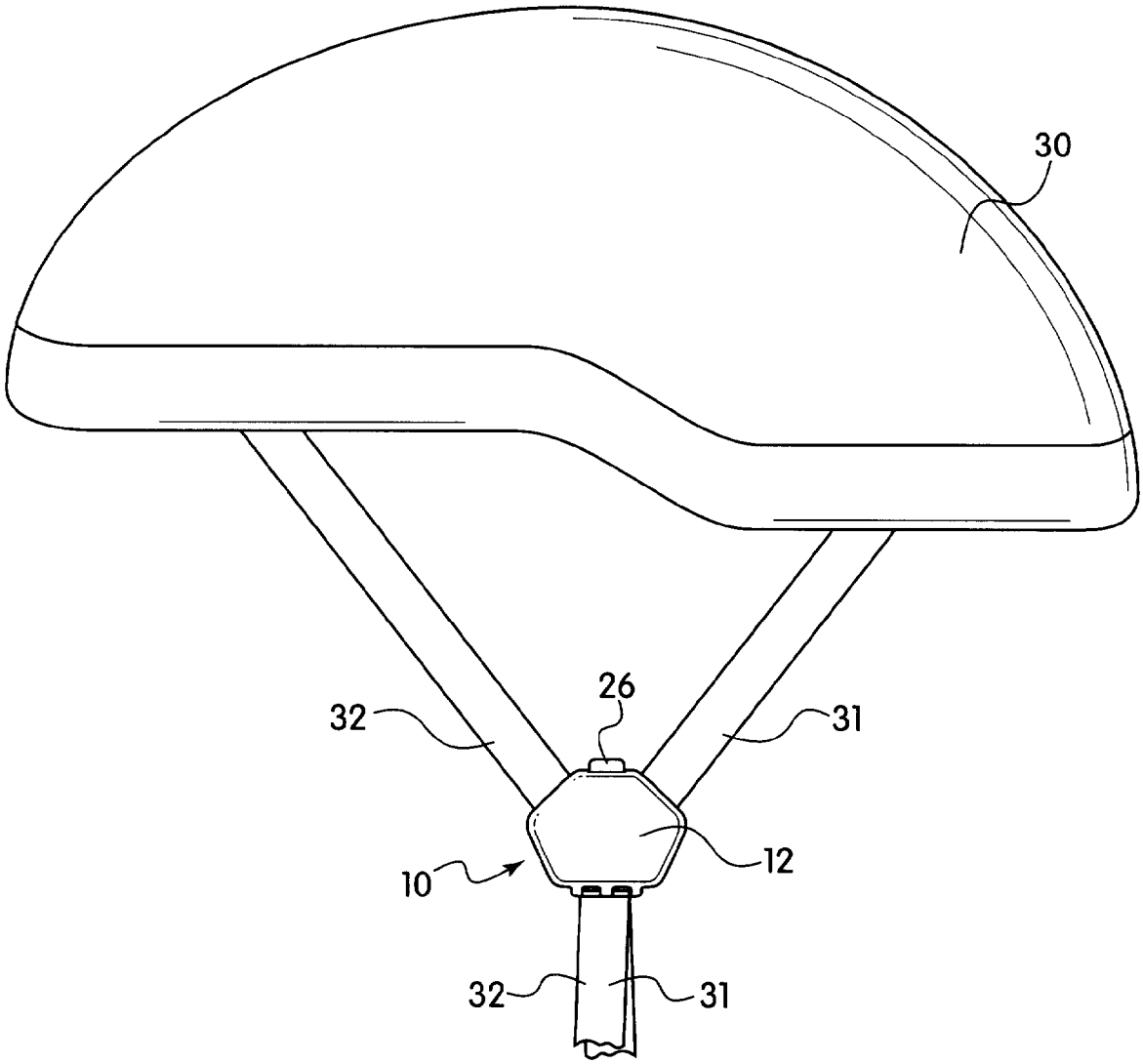
FIG. 3 shows an outside view of a bicycle helmet with the strap divider attached.
Figure 4:
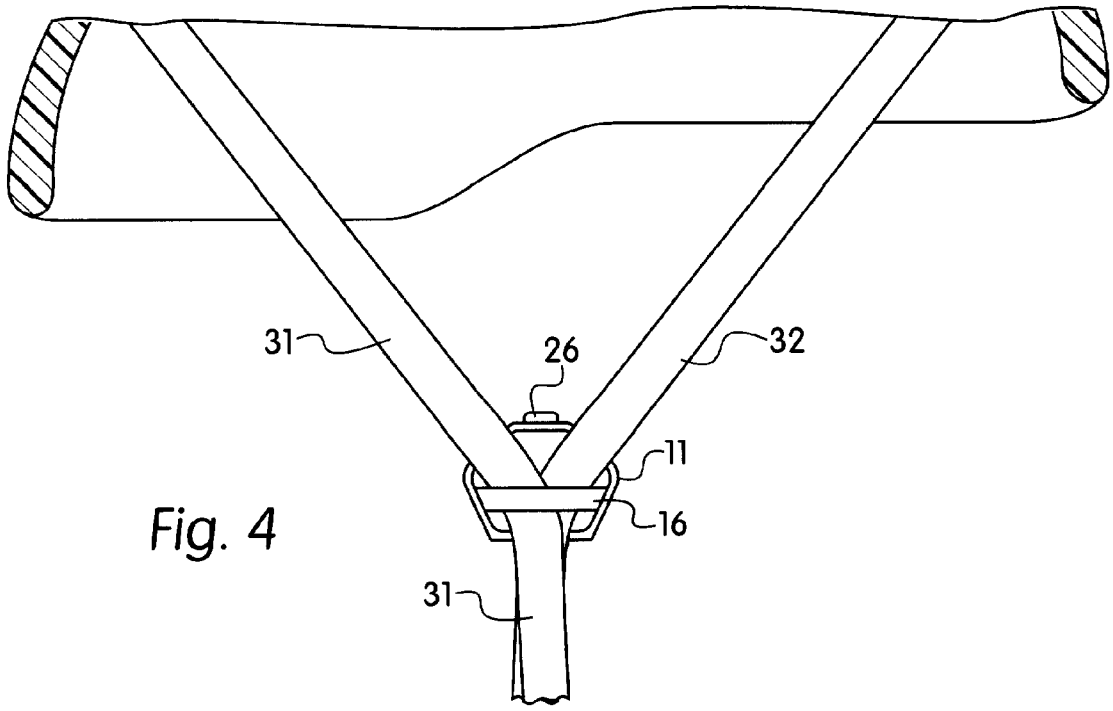
FIG. 4 shows an inside view of the bicycle helmet of FIG. 3 with the strap divider attached.
Figure 5:
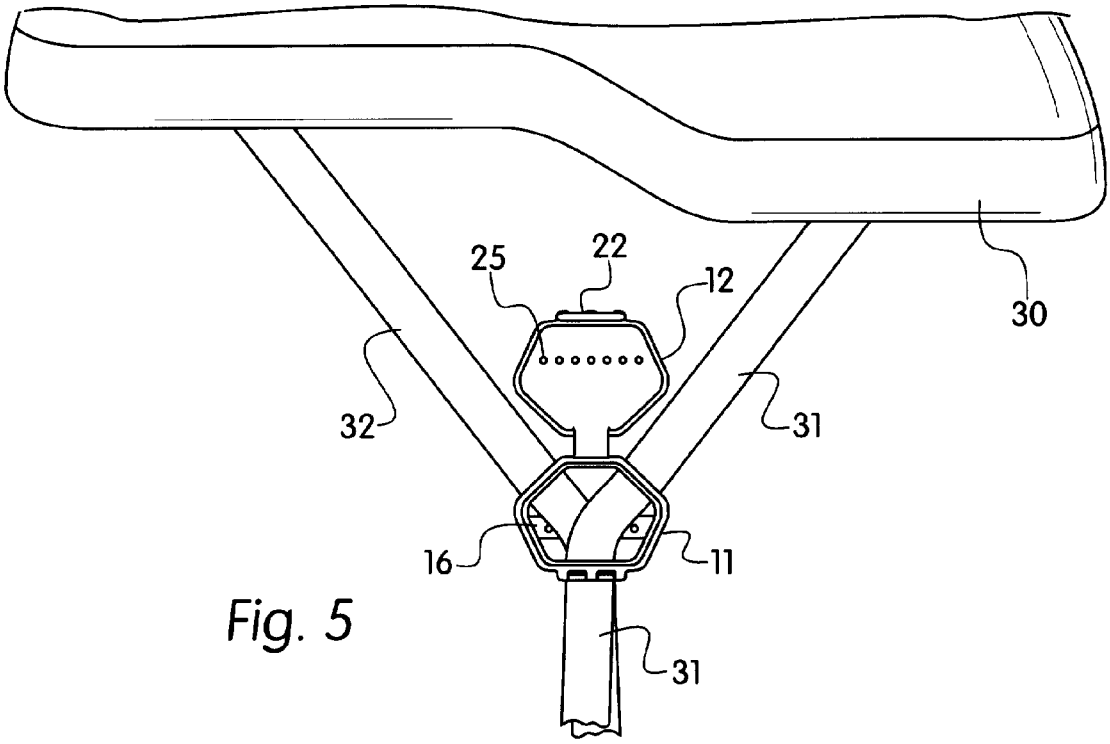
FIG. 5 shows an outside view of the bicycle helmet of FIG. 3 with the strap divider opened.
Figure 6:
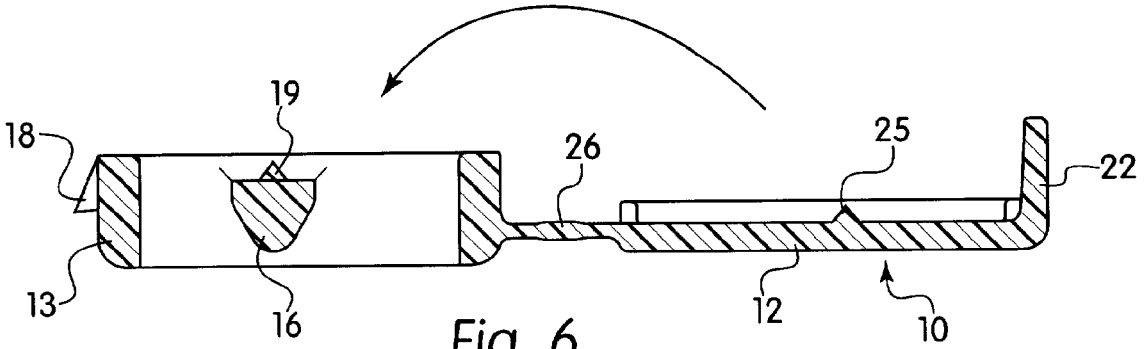
FIG. 6 shows a side cross-sectional view of the strap divider in an open position.
Figure 7:
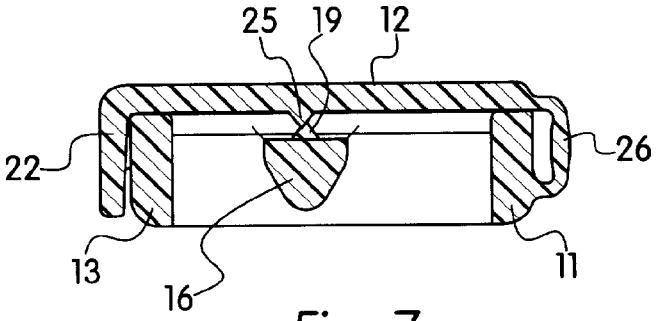
FIG. 7 shows a side cross-sectional view of the strap divider in a locked position.
Figure 8:
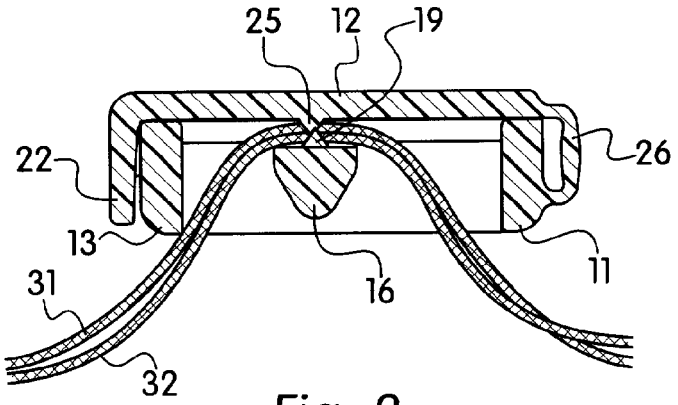
FIG. 8 shows a side cross-sectional view of the strap divider in a locked position with straps threaded therethrough.

As shown in FIGS. 3–5, strap divider 10 is used to divide and secure straps 31 and 32 of bicycle helmet 30 in an adjustable manner. Straps 31 and 32 are threaded around transverse bar 16 until the desired position is reached. Clamping portion 12 is then snapped down over strap receiving portion 11 to hold straps 31 and 32 in place. As shown in FIGS. 6–8, protrusions 19 and 25 cooperate to grip straps 31 and 32 more securely in strap divider 10.

Therefore, while only a single embodiment has been shown and described, it is obvious that many changes and modifications may be made thereunto without departing from the spirit and scope of the invention.

What is claimed is:

1. A divider for clamping a pair of straps, comprising:

a strap receiving portion having two sides, a front end, a rear end and a transverse bar mounted between the two sides;

a clamping portion pivotally connected to the rear end of the strap receiving portion, said clamping portion comprising a top surface and a bottom surface; and a clamping device for releasably locking the clamping portion over the strap receiving portion, wherein unlocking the clamping device from the strap receiving portion allows straps threaded through the strap receiving portion over the transverse bar on the strap receiving portion to be adjusted, and locking the clamping portion over the strap receiving portion locks the straps in place.

2. The divider according to claim 1, wherein the clamping portion is integrally formed with the strap receiving portion via a living hinge.

3. The divider according to claim 1, wherein the clamping device comprises:

at least one latch disposed on one of the clamping portion and the strap receiving portion; and at least one aperture on the other of the clamping portion and the strap receiving portion, wherein the aperture engages the latch to lock the clamping portion over the strap receiving portion.

4. The divider according to claim 3, wherein the latch is disposed on the strap receiving portion and the aperture is disposed on the clamping portion.

5. The divider according to claim 4, wherein the clamping portion comprises a flap along the front end, said flap extending perpendicular to the top and bottom surfaces of the clamping portion, and wherein the aperture is located on said flap.

6. The divider according to claim 3, wherein there are two latches and two apertures.

7. The divider according to claim 1, wherein there are a plurality of protrusions disposed on the bottom surface of the clamping portion for gripping the straps.

8. The divider according to claim 7, wherein there are a plurality of protrusions disposed on the transverse bar of the strap receiving portion for gripping the straps.

9. The divider according to claim 1, wherein the strap receiving portion and clamping portion are each in the shape of a hexagon.

* * * * *